United States Patent [19]

Krautkramer

[11] 4,019,663

[45] Apr. 26, 1977

[54] SEPARATING MEANS FOR PLASTIC CLOSURE TOP

[75] Inventor: Gunter Krautkramer, Budenheim, Mainz, Germany

[73] Assignee: Patentkommerz AG, Zurich, Switzerland

[22] Filed: July 8, 1975

[21] Appl. No.: 594,371

[30] Foreign Application Priority Data

July 9, 1974 Sweden ..... 89830/74

[52] U.S. Cl. ..... 222/529; 215/32; 222/541

[51] Int. Cl.[2] ..... B65D 47/10

[58] Field of Search ..... 222/541, 563, 569, 570, 222/182, 527, 528, 529, 530; 220/270, 276; 215/254, 256, 32

[56] References Cited

UNITED STATES PATENTS

| | | | |
|---|---|---|---|
| 2,661,128 | 12/1953 | Rieke | 222/541 |
| 3,128,900 | 4/1969 | Chaboche | 220/270 |
| 3,401,851 | 9/1968 | Newcomb | 222/527 |
| 3,424,330 | 1/1969 | Marcel | 215/256 |
| 3,608,771 | 9/1971 | Monroe | 222/541 |

FOREIGN PATENTS OR APPLICATIONS

| | | | |
|---|---|---|---|
| 1,296,038 | 5/1962 | France | 220/270 |
| 1,220,045 | 5/1960 | France | 222/541 |

*Primary Examiner*—Robert B. Reeves
*Assistant Examiner*—H. Grant Skaggs
*Attorney, Agent, or Firm*—Lawrence Rosen; E. Janet Berry

[57] ABSTRACT

A plastic closure for a container is molded in an integral single piece. The closure includes a closure ring at the bottom which seats in the opening in the container, a spout at the top of the closure; above the spout is a dual purpose closure element which seals the closure before its first use, and after the closure element is initially torn loose, the closure element is thereafter emplaced in and removed from the spout to seal the spout; integrally molded between the base of the closure element and the top of the spout is a tear off band having a removal handle such that drawing upon the handle removes the band and separates the closure element from the spout.

2 Claims, 2 Drawing Figures

SEPARATING MEANS FOR PLASTIC CLOSURE TOP

BACKGROUND OF THE INVENTION

The present invention relates to a plastic closure for a container, which closure has a sealing closure element that is initially formed with the closure and is later separable therefrom.

The present invention is an improvement upon the closure disclosed in application Ser. No. 485,183, filed July 2, 1974, by Hans Strub, and now U.S. Pat. No. 3,986,646, entitled "Plastic Closure Top for Tins" and assigned to the assignee hereof. The aforesaid application is incorporated herein by reference particularly with respect to its description of the problem to be solved by the invention described therein, its description of the prior art and its description of the manner in which the invention described therein accomplishes the purpose for which that invention is designed.

Summarizing some basic features of the plastic closure disclosed in the aforesaid application, it includes a base ring that is to be introduced into the mouth of the container, a pouring spout through which the contents of the container are emptied, a bellows between these elements and a closure element which is initially integrally formed with and initially seals the closure, which is separated from the closure to initially open the spout and which is adapted to thereafter be emplaced on and to reseal the spout. The entire closure is preferably integrally molded by, for example, an injection molding process. In order to economically manufacture an entire closure, it is desirable to form the closure element for the spout in the same molding or formation process in which the remainder of the closure is formed. Accordingly, the aforesaid application recites that there is integrally molded to the spout a closure element. This element comprises a hollow cylinder intended to fit into the opening of the spout once the closure element is separated from its initially molded connection to the spout. It also comprises a sealing disc which closes the top end of the closure element cylinder and the disc also carries the means by which the closure element is lifted from the spout when the closure element is used to reseal the spout.

The aforesaid application also notes that it is necessary that before the closure element can be used to reclose the spout, it must first be separated from its integrally molded attachment to the open end of the spout. Accordingly, the aforesaid application recites the interposition of a tear line between the free end of the spout and the open end of the closure means cylinder, along which tear line it is intended that the closure element be separated from the spout some time after molding.

It has been found that demarcation or formation of a tear line for separating the closure element from the spout, while effective, still does not provide independent means that facilitates the separation.

BRIEF DESCRIPTION OF THE INVENTION

According to the present invention, a separable tear band is defined in the closure during the formation by molding or other technique of the closure. The tear band is located between the free end of the spout around the spout opening, on the one hand, and the free open end of the closure means on the other hand. The tear band is integrally formed with the remainder of the closure. A first tearable connection joins the tear band to the spout and a second tearable connection joins the tear band to the closure element. The tear band includes means, such as a break or gap along its length, to facilitate its being torn from its location. The tear band remains in place until such time as it is intended to use the closure in the normal manner. then, the band is torn away and removed, thereby separating the spout and the closure element. The tear band according to the invention has the benefit that the separation between the spout and the closure means will be at the correct location on both of the spout and the closure means.

The tear band may further be provided with a grippable tear handle or the like means for facilitating the tearing away of the tear band. With the manner of attachment of the tear band to the spout and closure element being determinable by the manner in which the tear band is formed, a smooth, properly contoured spout outer surface can readily be formed.

Accordingly, it is an object of the present invention to provide an improved container closure.

It is a further object of the present invention to provide a closure that is an improvement over the closure discloseed in the aforesaid application.

it is another object of the invention to provide means for facilitating separation of the spout and closure element of the closure in the aforesaid application.

These and other objects of the invention will become apparent from the following description of the accompanying drawings.

DESCRIPTION OF A PREFERRED EMBODIMENT

The drawings show one embodiment of the closure of the invention, it being understood that the invention is adaptable for use with the various closure embodiments shown in the aforesaid application and with other closures which are capable of employing the invention.

Figure 1:
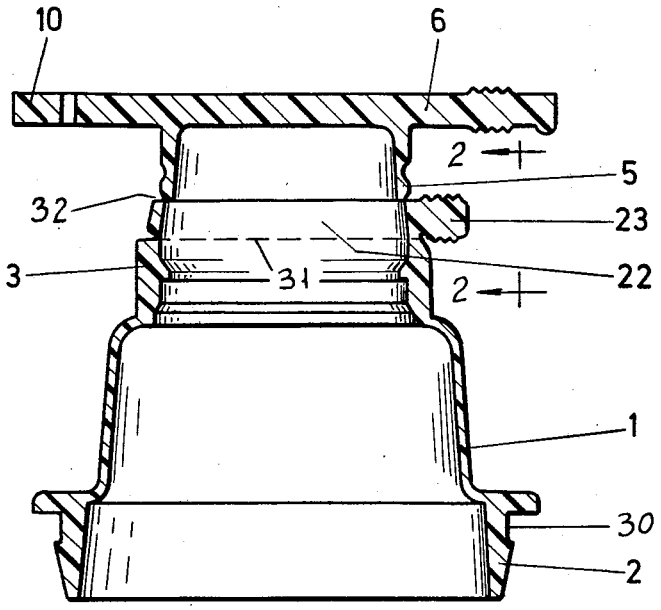
FIG. 1 is a longitudinal cross-sectional view of a closure according to the invention with the bellows of the closure pulled out and before the closure is separated into separate parts.

In FIG. 1, the integral closure is comprised of annular base ring 2 which is inserted into and is contoured to be affixed in the opening into a container, or thelike (not shown). The base ring exterior contour tapers narrower toward its open end. At the top of the base ring is a snap fastening slot 30 into which the peripheral wall defining the container opening snaps when the closure is emplaced. The closure further comprises the flexible material, annular sealing bellows 1, whose flexibility permits the closure to alternate between a closed, collapsed condition (shown in the aforesaid application) and the extended condition (shown in FIG. 1 herein). Bellows 1 is integrally joined to the top of base ring 2.

At the other end of bellows 1 is integrally attached a spout 3. From ring 2 through spout 3, the entire closure is hollow and defines a continuous open passage. Fluent material in the container (not shown) to which the base ring is attached exits, e.g., by being poured through the spout 3.

Above the spout 3 and, as illustrated in FIG. 1, spaced away therefrom is a closure element comprised of a hollow, short height cylinder 5 which is closed at its top end by a disc-shaped closure cap 6.

Interposed between the cylinder 5 and the spout 3 is the annular tear off band 22. It is a significant feature of the invention that the band 22 is integrally formed with the spout 3 beneath it and with the cylinder 5 above it. As a result, the entire closure from base ring 2 to closure cap 6 is an integral unit. The intended line of separation 31 between the tear off band 22 and spout 3 is delineated by a weakened section, such as a line of perforations or a narrowed width section of the material. Similarly, the intended line of separation 32 between the cylinder 5 and the tear off band 22 is defined by a similar weakened section.

Integrally attached to and projecting from the tear off band 22 is a hand graspable tear off band removal handle 23 which is grasped and pulled to start the tear on the tear off band and to complete removal of the tear off band by tearing it free of both the spout 3 and the cylinder 5 along weakened sections 31, 32.

Figure 2:
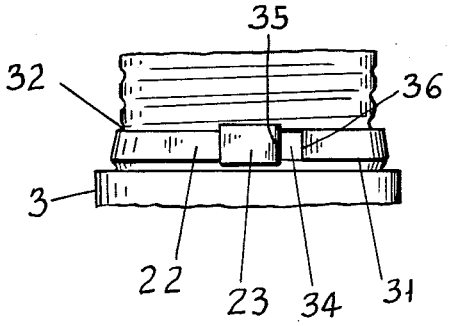
FIG. 2 is a side elevational view of a fragment of the closure of FIG. 1 in the direction of arrows 2 in FIG. 1.

In a preferred version, as illustrated in FIG. 2, the tear off band 22 extends nearly completely around the closure, except that there is a small break or gap 34 in the band adjacent to one side of the handle 23. The gap is defined between the adjacent facing ends 35, 36 of the band. Tearing of the band stats at the gap in the band and the band is unwound annularly from the closure. The tear off band with its handle 23 makes the separation of the hollow cylinder 5 together with its closure cap 6 from the pouring spout 3 considerably easier.

As detailed in the aforesaid application, the closure cap 6 further includes a swingable hand bracket 10 by which the cap closure may be swung, held or grasped. Other details of elements of the closure hereof may be found in the aforesaid application.

The entire closure is preferably comprised of plastic material with sufficient resiliency that the base ring can be snapped into the container opening and that the bellows 1 can be flexed and collapsed as needed.

It is a principal benefit of the invention that the entire closure from the closure element cap 6 at the top to the base ring 2 at the bottom and all the elements in between are integrally formed, for example, by a single injection molding. This eases manufacture, and ensures that the elements of the closure do not become separated prior to use. For other reasons mentioned in the aforesaid application, the formation of this closure as a single unit is beneficial.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. In an integrally formed plastic closure means for closing an opening in a container wherein said closure means comprises:

a base, said base having a bottom which has an opening into it; a ring at said base which is adapted to be introduced into the container opening; a snap fastening slot on said base for seating against the container, thereby to hold said closure means in position on the container;

a noncompressible spout defined at the opposite end of said closure means from said base and comprising an opeing into said closure means; said spout having a base end and a closable end;

a compressible bellows extending from said base to said spout base end; said closure means being hollow from said base opening through said bellows and said spout, thereby to enable fluent material to pass completely through said closure means;

a closure element for closing said spout opening; said closure element comprising a hollow cylinder having a first open end; said hollow cylinder having an opposite second end; an integrally connected disc sealing closed said cylinder second end of said closure element; joining means for joining said closure element to said spout closable end; and the entire said closure means being a one piece, integral plastic material unit, the improvemet comprising:

said joining means comprising a tear band interposed between and integrally connected on the one hand with said closure element cylinder first end and on the other hand with said spout around said spout closable end;

at said integral connection between said spout closable end and said tear band is defined a first tearable section that is comprised of such material and that is of such thickness and that has such characteristics that it is adapted to be torn upon application of tearing force thereto;

at said integral connection between said closure element cylinder first end and said tear band is defined a second tearable section that is comprised of such material and that is of such thickness and that has such characteristics that it is adapted to be torn upon application of tearing force thereto;

a graspable handle integrally formed on said tear band such that grasping and pulling said handle tears said first and said second tearable sections and thereby tears said tear band from said closure means and enables removal of said tear band, to initially separate the integrally connected said tear band from both of said spout and said closure element;

said compressible bellows being shaped such that when said bellows is compressed, the portion of said spout and of said closure element at said tear band are compressed by the compression of said bellows inside the portion of said bellows away from said tear band, whereby said tear band and said tearable sections are within and protected by said bellows;

said spout and said closure element cylinder being respectively cooperatingly contoured such that said closure element cylinder is shaped to seal said spout opening after said tear band has been removed from said closure means; said closure element having a grippable portion by which said closure element can be held, removed and replaced on said spout opening.

2. In the plastic closure means of claim 1, the improvement further comprising said tear band extending nearly completely around said closure means and said tear band having facing ends separated by a gap, thereby to facilitate tearing of said tear band away from said closure means.

* * * * *